United States Patent [19]

Aldrich, Jr.

[11] Patent Number: 4,966,074

[45] Date of Patent: Oct. 30, 1990

[54] WEB WRAP DETECTION SYSTEM FOR AN OFFSET WEB PRINTING PRESS

[76] Inventor: Wesley C. Aldrich, Jr., 12321 W. 52nd St., Shawnee, Kans. 66216

[21] Appl. No.: 309,214

[22] Filed: Feb. 13, 1989

[51] Int. Cl.[5] ..... B41F 5/06; B41F 5/22

[52] U.S. Cl. ..... 101/177; 101/228

[58] Field of Search ..... 101/228, 226, 219, 181, 101/233; 226/11, 45; 242/36, 37 R, 38–40; 250/562, 572; 271/262, 263, 258, 259; 340/675; 356/429, 430, 237, 238

[56] References Cited

U.S. PATENT DOCUMENTS 3,096,233 7/1963 Rappaport ..... 226/11

3,928,844 12/1975 Meihofer ..... 101/226

4,078,487 3/1978 McComb ..... 226/11

*Primary Examiner*—J. Reed Fisher

*Attorney, Agent, or Firm*—Hovey, Williams, Timmons & Collins

[57] ABSTRACT

A reliable, fast-acting, web wrap detection system is disclosed which is particularly useful inn an offset printing press for stopping operation thereof quickly enough to prevent the web from wrapping around a blanket cylinder. The preferred detection system includes optical sensors which sense blanket cylinder surface reflectance and which stop printing press operation upon an increase in reflectance, such being indicative that the higher reflectance printing web has begun to wrap the cylinder which occurs when the web breaks.

9 Claims, 1 Drawing Sheet

WEB WRAP DETECTION SYSTEM FOR AN OFFSET WEB PRINTING PRESS

BACKGROUND OF THE PRIOR ART

1. Field of the Invention

The present invention concerns a reliable, fast-acting, web wrap detection system for use with a printing press or the like which uses optical sensors to sense an increase in reflectance in the vicinity of a blanket cylinder and to stop printing press operation in response, such being indicative that the higher reflectance printing web has begun to wrap the cylinder as a result of web breakage.

2. Description of the Prior Art

In prior art printing presses or other devices which process an elongated fast moving web, the web travels through the device between pairs of opposed rotating rollers or cylinders. In these prior art devices, web breakage is typically detected by a means of so-called "electric eyes" mounted with a line of sight transverse to the path of travel of the web.

These prior art web wrap detection devices present a problem, however, in that they do not sense the web breakage until the trailing edge of the forward portion of the broken web passes by the next downstream electric eye. By the time the web breakage is detected, the upstream portion of the web may have already wrapped around one of the upstream cylinders or rollers. This results in additional down time to remove the wrapped web from the cylinders and, in some cases, may result in damage to the drive train. This problem is typically most severe in a printing press if the web breakage occurs downstream of the last electric eye just before the web enters the so-called "printing oven". When this occurs, the web may wrap itself many times around the last printing blanket cylinder before the break is detected as it exits the oven.

SUMMARY OF THE INVENTION

The problems with the prior art as outlined above are solved by the web wrap detection system of the present invention. That is to say, the system hereof quickly and reliably detects web breakage and shuts down the web processing apparatus before a significant amount of the web wraps a blanket cylinder or other transport roller in the web processing apparatus.

Broadly speaking, the preferred embodiment of the present invention includes optical sensors which monitor the surface reflectance of the transport rollers which the web is likely to wrap in the event of web breakage. When the web begins to wrap the surface of a transport roller, an increase in reflectance is detected to which the sensors respond to stop operation of the apparatus.

In particularly preferred forms, two spaced-apart sensors are provided for each roller being monitored to ensure reliability. This is particularly advantageous in the context of a printing press blanket cylinder in which the blanket cylinder seam may have sufficient reflectance to trigger a single sensor. Other preferred aspects of the present invention are discussed further hereinbelow.

BRIEF DESCRIPTION OF THE DRAWING FIGURES

DETAILED DESCRIPTION OF THE PREFERRED EMBODIMENT

Figure 1:
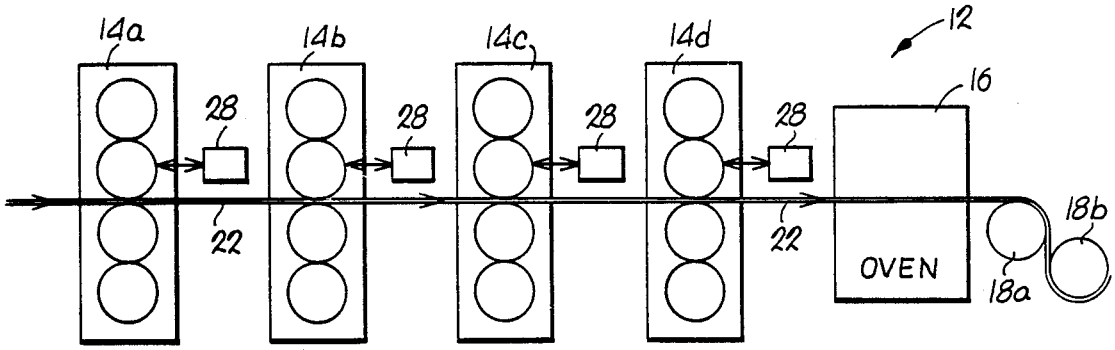
FIG. 1 is a schematic representation of a printing press having four print stages represented in end elevation and illustrating a web wrap detector associated with each stage.

The drawing figures illustrate web wrap detection system 10 in the preferred environment of use in a conventional offset printing press 12 which might include, for example, four printing stages 14*a, b, c,* and *d,* printing oven 16, take up rollers 18*a* and *b,* and drive control 20 (FIG. 4) in the form of a conventional motor starter control circuit which starts and stops operation of printing press 12. A web 22 of newsprint or other elongated flexible material to be processed passes through each printing stage 14*a–b* and oven 16 for take up on rollers 18*a,b.*

A typical printing stage 14*a–d* may include a pair of rotatable opposed printing rollers or blanket cylinders 24*a,b* between which web 22 travels. Printing cylinders 24*a,b* typically receive the ink to be imprinted on web 22 from printing plate cylinders 26*a,b* respectively.

As discussed above in connection with the prior art, breakage of web 22 as it passes through printing pass 12 presents a number of problems. When the web breaks, that portion of the web upstream of the break begins to wrap one of the blanket cylinders 24*a* which is typically the first cylinder upstream of the break. If the wrap continues to the point where it enters the nip between the printing cylinder 24*a* and the adjacent plate cylinder 26*a,* substantial down time may be involved in removing web 22 from between cylinders 24*a* and 26*a.* When such occurs, registration of the web is typically lost which must be reestablished involving additional down time and waste of the incorrectly printed web, and potentially may damage the drive train of press 12. Prior art devices for detecting web wrap typically use electric eyes mounted downstream of each printing stage 14*a–d* and which are aligned transverse to the travel of web 22 to detect a breakage. The problem of web wrapping a cylinder occurs because the prior art sensors do not sense the breakage until the trailing end of the web passes by that sensor. This allows sufficient time for the portion of the web upstream of the break to wrap one of the blanket cylinders.

In response to the problems of the prior art, the present invention recognizes that wrapping of a blanket cylinder is the first detectable symptom of web breakage and that the web presents certain optical conditions, that is, reflectance, which are detectable. In this regard, FIG. 2 schematically illustrates a typical printing stage 14 in which a downstream break in web 22 results in a portion thereof beginning to wrap a portion of printing cylinder 24*a.* FIG. 3 further illustrates this phenomenon from a front elevational view showing the optical reflectance contrast between web 22 and surface 28 of printing cylinder 24*a.*

Figure 2:
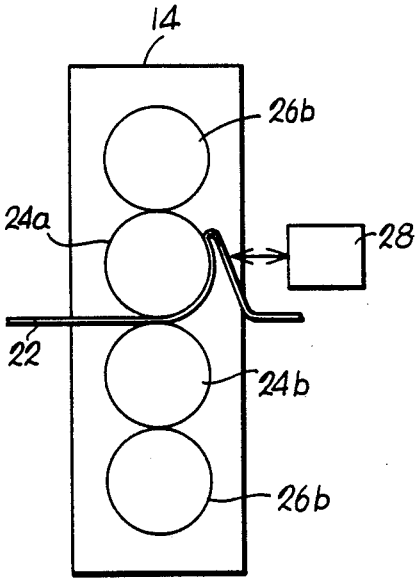
FIG. 2 is an end elevational representation of one printing stage of the printing press of FIG. 1 illustrating the web beginning to wrap a blanket cylinder.
Figure 3:
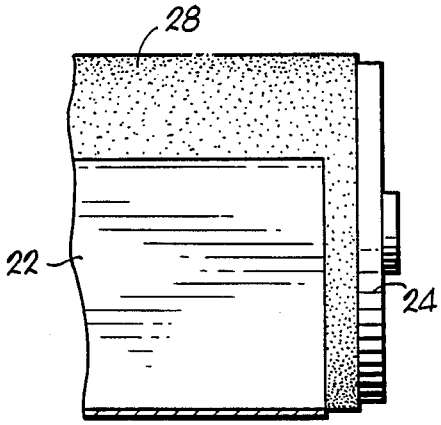
FIG. 3 is a partial front elevational view of the blanket cylinder of FIG. 3 illustrating the reflectance contrast between the blanket cylinder surface and the web partially wrapped thereon.

In order to solve the problems of the prior art, system 10 includes a detector assembly 28 which, in the preferred embodiment, is mounted in the vicinity of the upper print cylinder 24*a* of each printing stage 14*a–d* as illustrated in FIGS. 1 and 2. Experience indicates that the wrapping phenomenon typically occurs in relation to the upper blanket cylinder 24*a*, hence the inclusion of a respective detector assembly 28 in association therewith. In other uses of system 10, however, it may be that the wrapping phenomenon can occur in relation to any cylinder or roller between which web 22 travels. In such cases, it may be desirable to include a respective detection assembly 28 for each roller.

Detector assembly 28 preferably includes two optical sensors 30 and 32 mounted in an optical relationship with surface 29, manually operated latch switch 34, manually operated defeat switch 36, and a conventional electromechanical control relay which includes operating coil 38, normally open contact 40, and normally closed contact 42.

Figure 4:
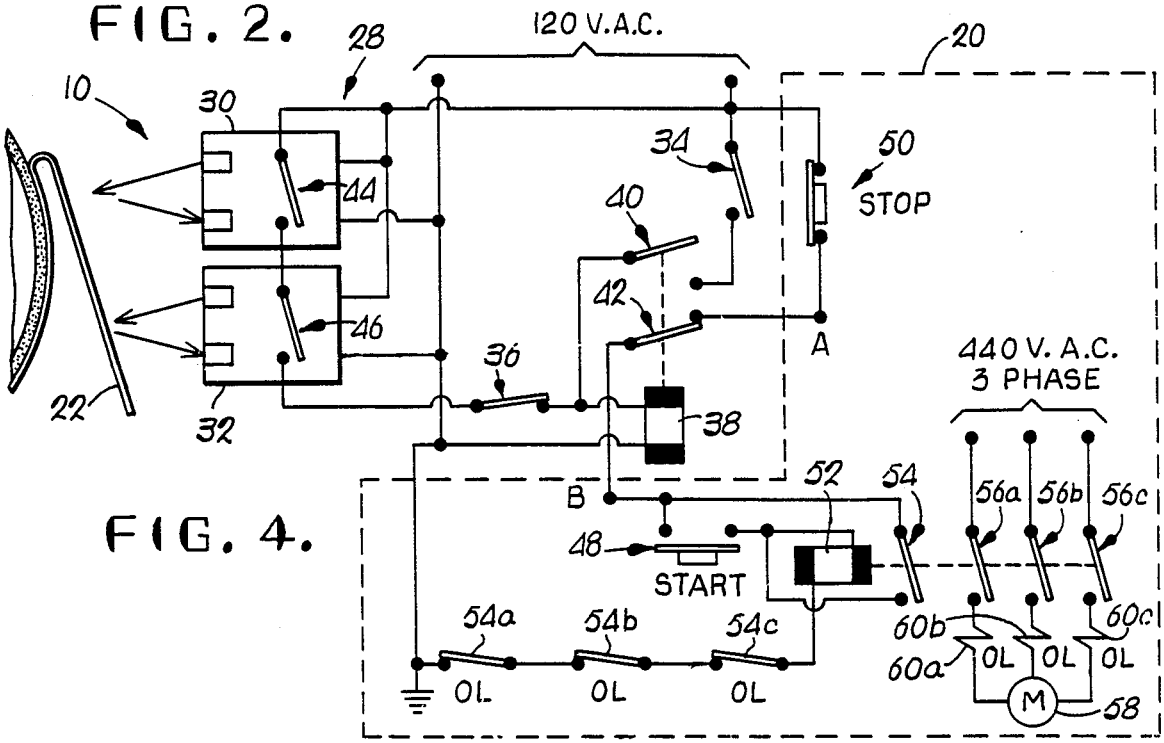
FIG. 4 is an electrical schematic representing a printing press motor control circuit and a detector having two sensors for sensing the web beginning to wrap the blanket cylinder of FIG. 3.

In the preferred embodiment, optical sensors 30, 32 are preferably VALU-BEAM model SMA915CV convergent mode sensors rated for 120 V.A.C. with each providing normally open and normally closed relay contact output (only the normally open contacts are used and shown in FIG. 4). Each sensor emits a beam of visible red light, senses a return reflection of the emitted beam, and, in response to a predetermined level of reflected light, changes the state of normally open relay contacts 44 and 46 respectively. Those skilled in the art will also appreciate that as an alternative arrangement, the respective normally closed relay contacts of sensors 30, 32 could be wired directly in series with stop switch 50.

System 10 preferably includes two sensors 30, 32 to ensure reliability in operation. Both sensors must sense predetermined optical conditions, that is, a predetermined level of reflected light, before printing press 12 is stopped. Additionally, some print cylinder blankets include a reflective metal seam which may reflect sufficient light to activate one of the sensors but does not present sufficient width to activate both simultaneously.

As illustrated in FIG. 4, sensors 30, 32 are mounted one above the other adjacent the right side (as viewed in FIGS. 1, 2, and 4) of a respective print roller 24*a*, that is, on the downstream side thereof relative to the path of travel of web 22. Additionally, sensors 30, 38 are mounted so that blanket cylinder surface 29 is within the field of view of sensors 30, 32. That is to say, sensors 30, 32 are mounted so that the respective emitted light beams are directed for impingement on surface 28.

Each detector assembly 28 is electrically coupled with drive control 20 of printing press 12 as illustrated in FIG. 4 and explained further hereinbelow.

Operation of printing press 12 is initiated by depressing start switch 48 which completes an electrical path from a conventional 120 volt A.C. source through normally closed stop switch 50, normally closed relay contact 42, to motor starter relay coil 52, and through thermal overload contacts 54, b, and c to the return path or ground. When motor starter relay coil 52 is energized, it closes hold-in contact 54 which maintains coil 52 energized after start switch 48 is released. When motor starter coil 52 is energized, it also closes motor starter contacts 56*a, b,* and *c* to energize printing press motor 58 from a source of 440 V.A.C. three phase power through thermal overload sensors 60*a, b,* and *c*.

In a typical printing press, blanket cylinders 24*a* present a relatively dark, non-reflective surface so that sensors 30, 32 do not sense sufficient refected light for activation. If web 22 breaks, however, a portion of web 22 upstream of the break begins to wrap a portion of cylinder 20*a* and thereby enters the field of view of sensors 30, 32. Web 22 presents optical conditions, that is, sufficient reflectance, when in the field of view of sensors 30, 32 in order to reflect enough light for sensing by sensors 30, 32. When this occurs, sensors 30, 32 close their respective relay contacts 44 and 46 which complete an electrical path from the source of 120 V.A.C. power through normally closed defeat switch 36 and through relay coil 38 to the return path or ground in order to energize coil 38. Coil 38 then opens contact 42 which deenergizes motor starter coil 52 which in turn opens contacts 56*a–c* to deenergize motor 58 and stop operation of printing press 12.

Manual opening of defeat switch 36 allows sensors 30, 32 to be electrically disconnected from the circuit in order to prevent them from stopping printing press operation. This may be desirable if one of the sensors malfunctions, for example.

Latch switch 34 is manually selectible between open or closed positions and is normally closed so that when coil 38 is energized and closes contact 40, an independent electrical path is completed from the source of 120 V.A.C. power through closed latch switch 34 and closed contact 40 to keep coil 38 energized. This in turn maintains contact 42 in the open position thereby preventing startup of printing press 12 even after the web is removed from the monitored portion of surface 29. The latch switch is desirable because, after printing press 12 is stopped, web 22 may fall from surface 29 thereby allowing start up of press 12 before anyone has checked for the existence of a breakage in web 22. Latch switch 34, when closed, requires the deliberate action of opening latch switch 34 before start switch 48 is enabled preventing inadvertent starting of printing press 12 before the web wrap problem has been corrected.

As those skilled in the art will appreciate, system 10 is useful for detecting web wrap with devices other than a printing press in which an elongated web of flexible material travels adjacent a roller and in which the web is subject to breakage and wrapping of the roller. In some of these other applications, the roller being monitored may not present sufficient reflectance in contrast to the web. In such cases, it may be desirable to provide at least a portion of the surface of the roller being monitored with reflectance characteristics to provide sufficient contrast with the web by painting or coating of the surface of the roller being monitored or providing a stripe of contrasting coating about a small portion of the periphery of the roller.

Other applications may also involve the circumstances where the web is relatively dark and provides low reflectance while the roller provides relatively high reflectance or can be coated or treated to provide such. In such cases, the normally closed contacts of sensors 30, 32 could be used.

Having thus described the preferred embodiment of the present invention, the following is claimed as new and desired to be secured by Letters Patent.

I claim:

1. In a printing press machine operable for handling an elongated web of flexible material, the improvement comprising:

drive control means operable for selective starting and stopping of machine operation;

at least one rotatable roller adjacent to which the web travels during machine operation, the roller being subject to wrapping by the web in the event of web breakage during machine operation, the roller having a peripheral surface presenting circumferentially offset portions thereof; and detection means for detecting wrapping said roller by the web, such being indicative of web breakage, said detection means including first and second sensor means operable for optically sensing the occurrence of respective predetermined optical conditions within the fields-of-view thereof, the web presenting said optical conditions, said roller portions being subject to presenting said optical conditions, mounting means for mounting said sensors adjacent said roller and offset from one another relative to roller rotation for presenting different circumferentially offset portions within the respective fields-in-view of said sensors, and means for operably coupling said sensors with said drive control means for stopping machine operation only when both of said sensors sense said respective optical conditions and for preventing stopping of machine operation by said sensors when only one of said roller offset portions presents said optical conditions.

2. The invention as set forth in claim 1, said predetermined optical conditions including a predetermined level of reflectance.

3. The invention as set forth in claim 2, said predetermined optical conditions including an increase in reflectance relative to the reflectance of said roller surface portions.

4. The invention as set forth in claim 1 said drive control means including a stop circuit, said detection means including switch means coupled in series with said stop circuit and operable to interrupt the stop circuit in the event of said occurrence.

5. The invention as set forth in claim 1, said detection means further including manually operable defeat switch means for selectively preventing said stopping of the machine operation in the event of said occurrence.

6. The invention as set forth in claim 1, further including activatable latch switch means for preventing starting of the machine until activation of said latch switch means after said stopping of the machine in the event of said occurrence.

7. The invention as set forth in claim 1, the machine including a plurality of said rollers, and including a corresponding plurality of said detection means.

8. The invention as set forth in claim 1, said roller being a blanket roller having a longitudinally extended seam corresponding to one of said roller portions and presenting said optical conditions.

9. In a printing press machine operable for handling an elongated web of flexible material, an improved method of operating a machine comprising the steps of:

providing drive control means operable for selective starting and stopping of machine operation;

providing at least one rotatable roller adjacent to which the web travels during machine operation, the roller being subject to wrapping by the web in the event of web breakage during machine operation, the roller having a peripheral surface presenting circumferentially offset portions thereof; and detecting wrapping of said roller surface by the web, such being indicative of web breakage, said detecting step including the steps of providing first and second sensor means operable for optically sensing the occurrence of respective predetermined optical conditions within the fields-of-view thereof, the web presenting said optical conditions, said roller portions being subject to presenting said optical conditions, mounting said sensors adjacent said roller and offset from one another relative to roller rotation for presenting different circumferentially offset roller portions within the respective fields-of-view of said sensors, and coupling said sensors with said drive control means for stopping machine operation only when both of said sensors sense said respective optical conditions and for preventing stopping of machine operation by said sensors when only one of said roller offset portions presents said optical conditions.

* * * * *